US007108735B2

(12) United States Patent
Hirata et al.

(10) Patent No.: US 7,108,735 B2
(45) Date of Patent: Sep. 19, 2006

(54) METHOD AND DEVICE FOR MANUFACTURING METALLIC PARTICULATES, AND MANUFACTURED METALLIC PARTICULATES

(75) Inventors: Yoshihiro Hirata, Kyoto (JP); Yoshio Ueda, Kyoto (JP); Hiroaki Takase, Kyoto (JP); Kazuaki Suzuki, Kyoto (JP)

(73) Assignee: Phild Co., Ltd., Kyoto (JP)

( * ) Notice: Subject to any disclaimer, the term of this patent is extended or adjusted under 35 U.S.C. 154(b) by 369 days.

(21) Appl. No.: 10/473,181

(22) PCT Filed: Mar. 26, 2002

(86) PCT No.: PCT/JP02/02912
§ 371 (c)(1),
(2), (4) Date: Jan. 12, 2004

(87) PCT Pub. No.: WO02/078884
PCT Pub. Date: Oct. 10, 2002

(65) Prior Publication Data

US 2004/0107798 A1 Jun. 10, 2004

(30) Foreign Application Priority Data

Mar. 28, 2001 (JP) ..... 2001-091942

(51) Int. Cl.
*B22F 9/08* (2006.01)

(52) U.S. Cl. ..... 75/355; 75/360

(58) Field of Classification Search ..... 75/343, 75/355, 360

See application file for complete search history.

(56) References Cited

U.S. PATENT DOCUMENTS 2,269,528 A 1/1942 Gallup
4,933,023 A * 6/1990 Wahlbeck ..... 148/522
6,869,626 B1 * 3/2005 Hirata et al. ..... 426/66
6,989,127 B1 * 1/2006 Hirata et al. ..... 419/67
2004/0091552 A1 5/2004 Hirata et al.
2004/0118244 A1 6/2004 Hirata et al.
2005/0072272 A1 4/2005 Hirata et al.

FOREIGN PATENT DOCUMENTS

EP 1 238 946 A 9/2002
EP 1 285 885 A 2/2003
HU 0203691 B 9/1991
JP 62-263903 11/1987
JP 02-290245 11/1990
WO WO 01/36337 A 5/2001
WO WO 01/85621 A 11/2001
WO WO 02/068342 A1 * 9/2002

* cited by examiner

OTHER PUBLICATIONS

Grenier S, "Plasma Atomization goes commercial," Met Powder Rep; Metal Powder Report Nov. 1998 Elesevier Sci Ltd., Exeter, Engl, vol. 53. 53, No. 11, Nov. 1998 pp. 26-28.

*Primary Examiner*—George Wyszomierski
(74) *Attorney, Agent, or Firm*—Knobbe, Martens, Olson & Bear LLP

(57) ABSTRACT

Produce metal particles offering high purity and uniform granular shape and size: by forming a combustion chamber comprising an injector nozzle for mixture gas of oxygen and hydrogen, an ignition device and a material metal feeder in the upper space of a high-pressure water tank filled with inert gas; igniting inside the combustion chamber via the ignition device the injector nozzle for mixture gas of oxygen and hydrogen and melting (vaporize) the material fed by the material metal feeder; and then causing the produced molten metal droplets to contact high-pressure water and let the resulting metallic particles to precipitate in water.

8 Claims, 2 Drawing Sheets

METHOD AND DEVICE FOR MANUFACTURING METALLIC PARTICULATES, AND MANUFACTURED METALLIC PARTICULATES

This application is the U.S. National Phase under 35 U.S.C. §371 of International Application PCT/JP02/02912, filed Mar. 26, 2002, which claims priority of Japanese Patent Application No. 2001-91942, filed Mar. 28, 2001. The International Application was published under PCT Article 21(2) in a language other than English.

FIELD OF THE INVENTION

This invention relates to a method and apparatus for producing metallic particles offering high purity and uniform granular shape and size, as well as metallic particles produced by the method and apparatus. The invention also relates to a production of fine titanium powder, among others, as the aforementioned fine metal powder.

BACKGROUND OF THE INVENTION

Raw element metals are processed into various forms, such as molded shapes, sheet, bar, thin wire or foil, according to applications. In recent years the use of metal powder as molding material is drawing the attention in the fields of powder metallurgy, thermal spraying and other molding techniques. Particularly, powder metallurgy is regarded as an important technology offering wide applications, including production of metal parts, and therefore demand for powder metal—which is the base material for powder metallurgy—is also growing.

Production of metal powder traditionally used the classic method of mechanically and directly crushing metal granules into powder form or the method to blow molten metal with gas pressure to form powder. However, all these and other methods had difficulty achieving uniform granular shape and size, economy, and so on.

Electrolysis is one of relatively new methods for metal powder production. It has been reported that smooth, minute and uniform crystalline structures can be deposited under appropriate conditions, and that performing electrolysis outside the range of these conditions produces brittle metal of sponge or powder form.

Still, these newer production methods did not produce metal particles of satisfactory shape and size uniformity nor did they resolve other problems such as economy.

Among other metals, titanium is a relatively new metal compared with iron, copper and aluminum that have been in use since ancient times. Titanium is light and offers excellent strength at high temperature as well as corrosive resistance, and is therefore used widely in industrial applications.

The sample applications of titanium include jet engine material and structural member for aircraft/spaceship, material for heat-exchangers used in thermal and nuclear power generation, catalyst material used in polymeric chemical products, articles of daily use such as eyeglass frame and golf club head, and material for health equipment, medical equipment and medical/dental material. The applications of titanium are expected to grow further. Titanium, which is already competing with stainless steel, duralumin and other high-performance metals in terms of applications, is likely to surpass its rivals in the future.

Since titanium metal has poor processability and machinability, producing a mechanical part having complex shape from molten titanium will add to manufacturing man-hours and costs. It is because use of molten titanium as material will require cutting and other machining steps following the plastic working process such as hot forging and rolling.

Therefore, powder metallurgy is widely used in titanium metal processing, which is the reason for the growing demand for titanium powder, particularly one offering high purity and good uniformity of granular shape and size. Titanium powder produced by the conventional powder production methods designed for general metals is subject to the same problems with other metals; i.e., irregular granular shape and size, poor economy, and so on. As a result, development of a production method that can provide titanium powder offering high purity and uniform granular shape and size is eagerly awaited.

For example, the hydrogenative dewatering method and rotary electrode method are being put to practical use as improved production methods for titanium metal powder. The hydrogenative dewatering method uses sponge titanium, molten titanium or titanium chips generated from cutting/machining as material. The material titanium is heated in a hydrogen atmosphere to cause it to absorb the hydrogen gas and thus become brittle. This brittle titanium is then crushed and heated again in vacuum so that the hydrogen gas will be released and powder formed. In the rotary electrode method, molten titanium or titanium melted then forged, rolled or otherwise worked is formed into a round bar to be used as material. This material round bar is turned at high speed in an atmosphere of argon, helium or other inert gas, while its tip is melted by a heat source such as an arc or plasma-arc torch. The drips of molten metal are then scattered via centrifugal force to produce spherical powder particles.

The particles of titanium powder obtained by the hydrogenative dewatering method have irregular sphericity. Although this powder can be used in die molding, the heating process must be repeated twice. A crushing process using a ball mill or other mechanical means may be incorporated, but oxygen contamination of titanium powder cannot be avoided. In the rotary electrode method, material titanium is melted in an inert gas and made into powder form. Therefore, particles are spherical and offer good flowability. They are not subject to oxygen contamination, either. However, the solidification property when molded will be reduced. Both methods are a batch system, so the power production cost is high.

The atomization method was developed as a titanium powder production method addressing the aforementioned problems relating to quality and production cost. In the atomization method, material titanium is melted in a water-cooled copper crucible using a plasma-arc torch or other heat source, in order to cause molten titanium to drip continuously from one end of the crucible. Argon, helium or other inert gas is then injected onto the molten titanium to atomize it and obtain powder. However, this method could not reduce the production cost significantly from the levels of the conventional methods, because molten titanium or melted and worked titanium had to be used as material.

In the meantime, a method for producing powder titanium offering improved sphericity and flowability for easier molding, in a manner requiring less cost and avoiding oxygen contamination, is disclosed in Japanese Patent Application Laid-open No. 5-93213. In this method, sponge titanium is isostatically pressed cold into a solid bar. This bar material is then melted in an inert gas, after which argon, helium or other inert gas is injected onto the dripping molten titanium to atomize it and obtain powder. However, this improved method did not offer good purity or uniformity of granular shape and size and the production cost was not at a satisfactory level, either.

SUMMARY OF THE INVENTION

As described above, there is an increasing need and demand for metal powder, especially titanium metal powder, with the progress of powder metallurgy and other new molding methods. However, powder production methods that sufficiently answer such demand were not available and the existing methods had problems, particularly in regard to the purity of element metal, uniformity of granular sphericity and size of powder, and production cost.

The purpose of the present invention is to provide, in an economical manner, element-metal powder material offering excellent uniformity of granular sphericity and consistency of granule size, for use in powder metallurgy and other types of molding, by solving the aforementioned problems associated with the conventional technologies.

To achieve the above purpose, the inventors conducted various studies to resolve the problems associated with the production of element metal powder such as titanium powder, including those pertaining to the purity of element metal, uniformity of granular sphericity, consistency of granule size and production cost.

With regard to the above, titanium powder can be created during the production process for high-function water containing titanium, as specified in Japanese Patent Application No. 2000-136932 proposed earlier by the inventors.

The aforementioned invention relating to a production of high-function water containing titanium (Japanese Patent Application No. 2000-136932), proposed earlier by the inventors, provides a method for producing high-function water in which molten titanium is dissolved, wherein the method is characterized by the burning of a mixture gas of oxygen and hydrogen in high-pressure water and the melting of titanium metal using the combustion gas. It was expected that by utilizing this technology, powder offering high purity and uniform granular sphericity and size would be obtained and the production cost would also be reduced significantly.

However, the aforementioned preceding invention had the problem of insufficient melting of material metal, which was caused by a narrow range of combustion gas atmosphere resulting from a mixture gas of oxygen and hydrogen being burned in high-pressure water.

After examining various ways, the inventors found that the problem of the preceding invention would be solved by burning a mixture gas of oxygen and hydrogen in a high-pressure water tank having an injector nozzle for supplying a mixture gas of oxygen and hydrogen into its upper space.

In other words, the present invention, which is based on the aforementioned finding, essentially provides a method for producing metallic particles, which is characterized by filling the upper space of a high-pressure water tank with inert gas; forming a combustion chamber in the space comprising an injector nozzle for mixture gas of oxygen and hydrogen, an ignition device and a material metal feeder; igniting inside the combustion chamber via the ignition device the mixture gas of oxygen and hydrogen injected from the aforementioned injector nozzle; using the combustion gas to melt (vaporize) the material metal fed by the material metal feeder; and then causing the produced molten metal droplets (vapor) to contact high-pressure water to instantly crush and solidify the droplets/vapor and allow the produced fine particles to precipitate in water for recovery.

Additionally, the present invention essentially provides an apparatus for producing metallic particles, which forms a combustion chamber comprising an injection nozzle for mixture gas of oxygen and hydrogen, an ignition device and a material metal feeder, in the upper space of a high-pressure water tank filled with inert gas, and consists of a pressure-resistant container comprising a pump that feeds the gas in the upper space into high-pressure water and a dryer that dries the aforementioned gas traveling upward in high-pressure water, after the gas is collected and before it is released into the upper space.

The method proposed by the present invention generates virtually no byproducts or impurities other than the target element metal powder. Occurrence of metal oxidation due to heating of material metal is also very small, and since the obtained metal powder has excellent uniformity of granular sphericity and consistency of granule size, the production cost can be reduced significantly. The method also allows for continuous production in addition to batch production, which opens a door to mass-production of metal powder.

In the aforementioned production process, a mixture gas of oxygen and hydrogen is burned in the upper space of the high-pressure water tank to achieve a high-temperature state. This heat is used to melt or vaporize material element metal (a metal whose evaporating temperature is equal to or below the combustion temperature of the mixture gas of oxygen and hydrogen will evaporate and become gas). Upon contact with high-pressure water, the molten droplets or vapor will instantly disperse in water and turn into fine particles to form metal powder.

Unlike the preceding invention (Japanese Patent Application No. 2000-136932), the upper space in the high-pressure water tank is filled with inert gas (such as argon and neon). Therefore, even with a chemically active metal such as titanium or zirconium, the molten metal droplets or vapor produced by the combustion of mixture gas will virtually remain intact, except for slight formation of oxidized film on the surface, and will quickly precipitate at the bottom of water in powder form. As a result, high-purity titanium or zirconium powder will be obtained.

To sum up, the basic structure of the present invention is to burn a mixture gas of oxygen and hydrogen in the upper space of a high-pressure water tank and use the combustion gas to melt (vaporize) material element metal and let it disperse/precipitate in water, thereby producing metal powder. A schematic drawing of the production process is shown in the production flow chart given in FIG. 1.

The present invention comprises components (1) through (7) below, which basically serve to bum a mixture gas of oxygen and hydrogen in the upper space of a high-pressure water tank and use the combustion gas to melt (vaporize) material metal and let it disperse/precipitate in water, thereby producing metal powder.

(1) A method for producing metallic particles, which is characterized by filling the upper space of a high-pressure water tank with inert gas; forming a combustion chamber in the space comprising an injector nozzle for mixture gas of oxygen and hydrogen, an ignition device and a material metal feeder; igniting inside the combustion chamber via the ignition device the mixture gas of oxygen and hydrogen injected from the aforementioned injector nozzle; using the combustion gas to melt (vaporize) the material metal fed by the material metal feeder; and then causing the produced molten metal droplets (vapor) to contact high-pressure water to instantly crush and solidify the droplets/vapor and allow the produced fine particles to precipitate in water for recovery.

(2) A method for producing metallic particles as described in (1) above, wherein the gas in the upper space of the high-pressure water tank is fed into high-pressure water via a pump and the aforementioned gas is collected as it travels upward in high-pressure water, dried and then released into the upper space.

(3) A method for producing metallic particles as described in (1) or (2) above, wherein the material metal is titanium, zirconium, germanium, tin, gold, platinum or silver.

(4) A method for producing metallic particles as described in (1), (2) or (3) above, wherein the shape of the material metal is bar, sheet, wire, foil or granule, or any combination thereof.

(5) An apparatus for producing metallic particles, which comprises a pressure-resistant container comprising a combustion chamber comprising an injection nozzle for mixture gas of oxygen and hydrogen, an ignition device and a material metal feeder, in an upper space of a high-pressure water tank filled with inert gas, a pump that feeds the gas in the upper space into high-pressure water and a dryer that dries said gas traveling upward in the high-pressure water, after said gas is collected and before it is released into the upper space.

(6) An apparatus for producing metallic particles as described in (4) above, wherein the apparatus has as an adjunct a water electrolyzer for producing a mixture gas of oxygen and hydrogen.

(7) Metallic particles produced by the method described in (1), (2), (3) or (4) above or the apparatus described in (5) or (6) above.

DESCRIPTION OF THE SYMBOLS

Figure 1:
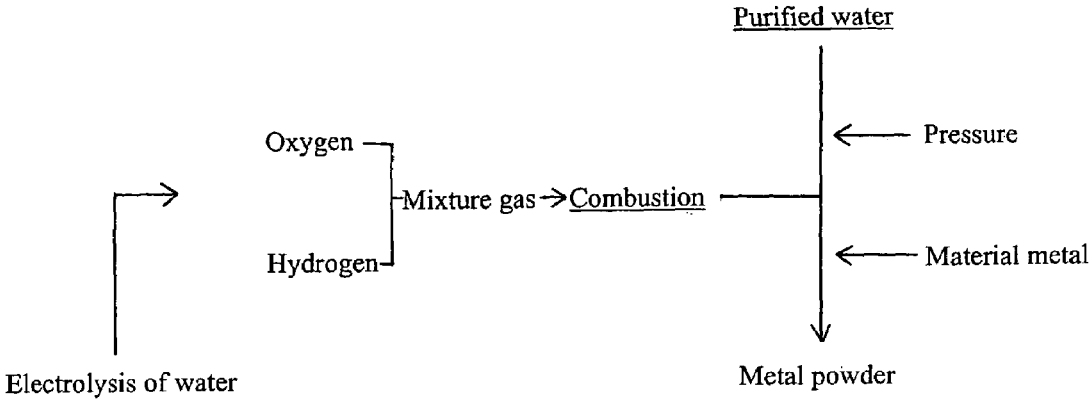
FIG. 1: Flow chart of metal powder production as proposed by the present invention

1: Apparatus for producing metal powder
2: Pressure-resistant container for metal powder production
3: Electrolyzer
4: Mixture-gas injection pump
5: High-pressure water tank
6: Combustion chamber
7: Pressure control valve
8: Metal powder outlet
9: Purified water
10: Material element metal
11: Ignition plug
12: Metallic particles
13: Metal feeder part
14: Mixture-gas injector nozzle
15: Hydrogen-gas feed pipe
16: Oxygen-gas feed pipe
17: Electrode
18: Electrode
19: Partition
20: Water
21: Atmosphere-gas suction pump
22: Dryer
23: Atmosphere-gas exhaust/circulation pump

BEST MODE FOR CARRYING OUT THE INVENTION

The following explains the present invention by taking a production of titanium metal powder as an example. Note, however, that the invention is not limited to production of titanium powder.

First, according to the present invention, purified water such as distilled water and inert gas such as argon are filled into the high-pressure water tank, which is the pressure-resistant tank for titanium-metal powder production, and the tank is pressurized at a high pressure. Then, material titanium metal such as a titanium bar is fed from the material element-metal feeder part, hydrogen and oxygen are injected from the nozzle as a mixture gas, and this mixture gas is ignited and completely burned inside the combustion chamber to achieve a perfect combustion state leaving an ultra-high-temperature steam gas. Material titanium is instantly melted in this combustion gas and dispersed in water. Since the combustion atmosphere is inert gas, a majority of the produced titanium droplets remain as metal. Thus very fine titanium particles of micron order are generated and dispersed in water in powder form. The produced fine titanium powder precipitates in a short period.

Since the mixture gas of oxygen and hydrogen has a theoretical mixture ratio of 1 to 2, the gas bums completely even in an inert gas atmosphere to reach a maximum temperature of 2850° C. The resulting steam will be fed into high-pressure water via an atmosphere-gas suction pump, where the steam is condensed and mixed with high-pressure water. The inert gas collected from water will be circulated back to the upper space of the high-pressure water tank after removing moisture content with a dryer.

The present invention can produce titanium powder of high purity at a very high efficiency. To achieve this, it is important to control the amounts of gases to be mixed and burned, reaction pressure and feed rate of material titanium metal.

With the production apparatus proposed by the present invention, an ideal injection amount of mixture gas is approx. 3 to 5 liters per second when the container can hold one ton of purified water. Applying too high a gas pressure may damage the apparatus structure, while a low pressure may cause the gas to flow upward from the nozzle, causing the heated, molten metallic particles to be encapsulated in air bubbles and diffused from the water surface. This will reduce the generation efficiency of metallic particles. The water pressure in the pressure tank should be 5 to 10 atmospheres. An appropriate feed rate of material titanium metal into the combustion chamber is 0.3 to 0.5 kg/min.

The supplied material titanium metal should preferably have the highest possible purity, in order to prevent impurities from mixing into the produced titanium powder.

A mixture gas of hydrogen and oxygen provides the most efficient and stable means of melting titanium metal (melting point: 1660° C., boiling point: 3300° C.), where high pressure is required to ensure stable combustion. Physical or chemical explanations as to why molten titanium metal melts instantly and becomes fine particles in high-pressure water have not been found yet; however, it is considered that the molten droplets are dispersed and broken into small pieces due to the impact of colliding with the water surface.

Material titanium metal may take a shape of bar, sheet, granule or foil, or any combination thereof, and it may be appropriate to supply granules instead of bar if the capacity of the production container is much smaller than one ton.

In addition to titanium, the material element metals that can be used in the production of metal powder using the production apparatus proposed by the present invention include, but not limited to, zirconium (Zr), germanium (Ge), tin (Sn), gold (Au), platinum (Pt) and silver (Ag).

The high-pressure water tank used in the apparatus proposed by the present invention is a pressure-resistant tank made of metal, or preferably steel, and ideally other parts such as the combustion chamber should also be made of steel. The gas pump is installed to blow out a mixture gas at high pressure. Material element metal is fed continuously in accordance with the melt amount.

Material element metal must be fed into a position where the mixture gas burns completely and fully turns into a steam gas of ultrahigh temperature. The combustion chamber is installed to burn the mixture gas to achieve this purpose. This setup allows for production of pure metal powder free from impurities or byproducts. High pressure is also required to completely bum a pure mixture gas.

An actual embodiment of the present invention is explained according to the drawings. Note, however, that the invention is not limited to this example.

Figure 2:
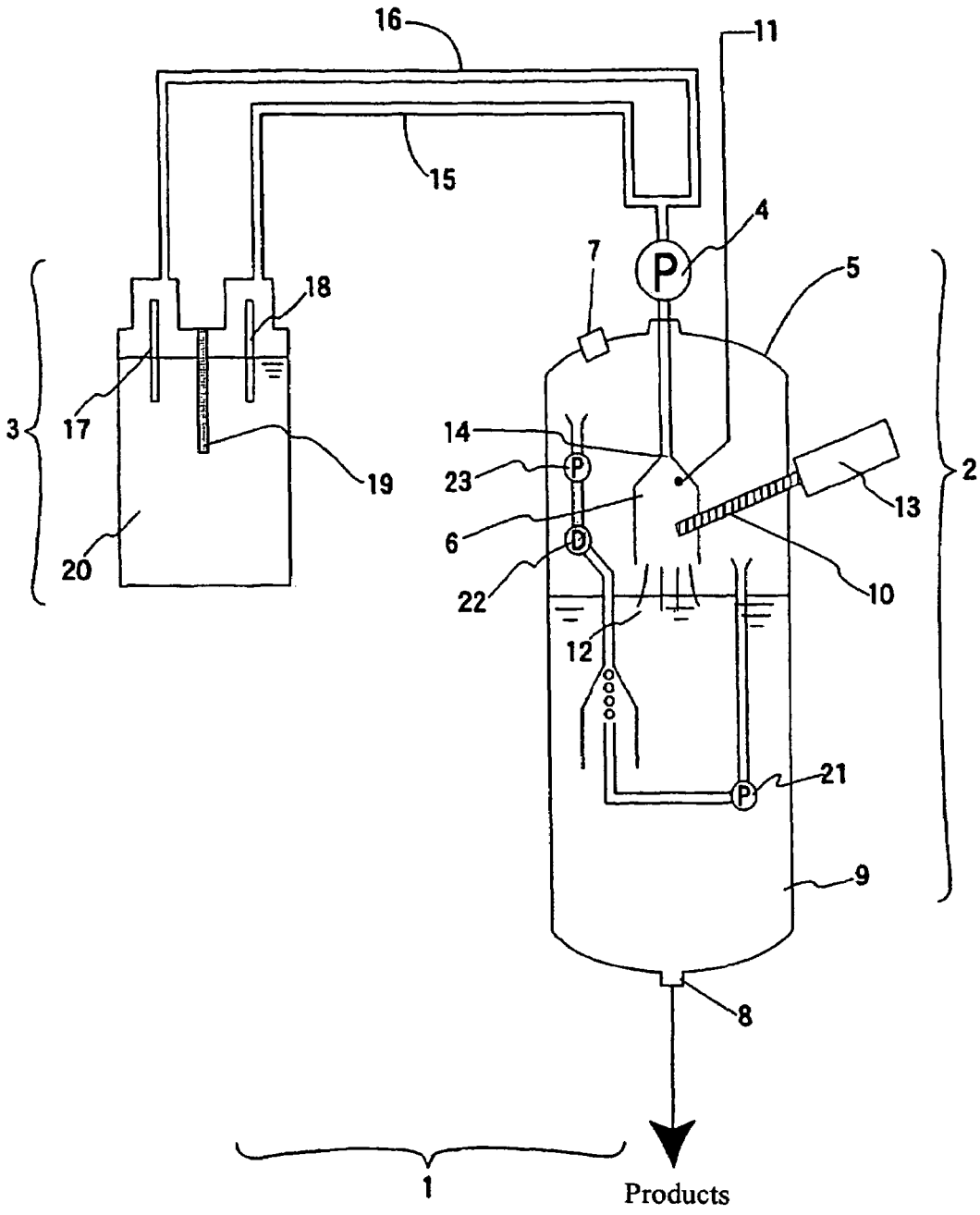
FIG. 2: Schematic drawing of an apparatus for producing metal powder as proposed by the present invention

FIG. 1 shows a flow chart of metal powder production as proposed by the present invention, as described earlier. An apparatus for producing metal powder (1) shown in FIG. 2 consists of a pressure-resistant container (2) that comprises a high-pressure water tank (5), an injector nozzle for mixture gas of oxygen and hydrogen (14), a material element-metal feeder part (13), an ignition plug (11) and a combustion chamber (6).

The upper space of the container is filled with inert gas, and a pump (21) to deliver this atmosphere gas into high-pressure water, as well as another pump (23) that exhausts and circulates into the upper space the inert gas collected from water and dehumidified through a dryer (22), are installed.

The apparatus for producing metal powder (1) consists of a pressure-resistant container for metal powder production (2), and the pressure-resistant container for metal powder production comprises a gas injection pump (4), a high-pressure water tank (5), a combustion chamber (6), a pressure control valve (7), a metal powder outlet (8), purified water (9), material element metal for powder production (10), an ignition plug (11), a material element-metal feeder part (13) and a mixture-gas injector nozzle (14). (12) indicates produced metal powder.

Purified water (9) such as distilled water is filled into the high-pressure water tank (5) of the pressure-resistant container for metal powder production (2), and material titanium metal (10) such as a titanium metal bar is fed from the material element-metal feeder part (13), after which the container is pressurized at a high pressure. Hydrogen and oxygen are injected from the nozzle (14) as a mixture gas and the mixture gas is ignited by the ignition device (11). The mixture gas is completely burned in the combustion chamber (6) to obtain a perfect combustion state leaving an ultrahigh-temperature steam gas, and the material titanium melts instantly in this combustion gas and disperses in water.

At this time, very fine titanium particles of micron order (12) are produced and dispersed in powder form. The titanium metal powder does not melt or float and precipitates as powder in a short period. The separated powder is then released from the outlet for titanium powder (8) and becomes titanium powder.

The supply of mixture gas of hydrogen and oxygen must be precisely controlled to achieve a hydrogen-to-oxygen ratio of 2 to 1. While a mixture gas of hydrogen and oxygen is supplied from commercial gas cylinders, adding a water electrolyzer (3) as an adjunct to produce a mixture gas of hydrogen and oxygen via electrolysis of water will generate completely pure gases to facilitate an optimal, efficient supply of mixture gas.

In the present invention, adding a water electrolyzer (3) as an adjunct, instead of supplying a mixture gas of hydrogen and oxygen from commercial gas cylinders, will generate completely pure gases via electrolysis of water, thereby facilitating a supply of mixture gas in a simple and efficient manner. When adding a water electrolyzer for production of mixture gas of oxygen and hydrogen as an adjunct, the electrolyzer (3) is considered an optional adjunct unit to produce and supply a mixture gas of hydrogen and oxygen via electrolysis of water, which consists of feed pipes for hydrogen and oxygen gases (15, 16), electrodes (17, 18), a partition (19) and water (20). The electrolyzer causes electrolysis of acid or alkali raw water to generate oxygen gas at the anode and hydrogen gas at the cathode, and supplies them as a material mixture gas.

Production Conditions and Results

Pressurized water: 1 ton Pressure: 2 kg/cm$^2$(2 atmospheres)

Internal pressure of production tank: 2 atmospheres

Mixture gas: 5 L/sec (3.5 atmospheres)

Injection period: 1 hour

Feed rate of titanium metal: 30 kg

Production volume of titanium powder: Approx.30 kg

Evaluation of Produced Titanium Powder

The element titanium powder contained no byproducts or impurities and exhibited excellent uniformity of granular sphericity and consistency of granule size. The production cost was reduced around a half compared with the conventional technologies.

Industrial Field of Application

The present invention allows for production of high-purity metal, especially titanium powder, in a very efficient manner. The production method proposed by the present invention achieves pure powder free from byproducts or impurities other than the elemental component, wherein the produced powder offers excellent uniformity of granular sphericity and size and can be produced at significantly less cost. Batch production, continuous production and mass production are also possible.

What is claimed is:

1. A method for producing metallic particles, comprising:

filling with inert gas an upper space of a high-pressure water tank containing high-pressure water, wherein a combustion chamber is formed in said space, said combustion chamber comprising an injector nozzle for mixture gas of oxygen and hydrogen, an ignition device, and a metal material feeder;

igniting inside said combustion chamber via the ignition device the mixture gas of oxygen and hydrogen injected from the injector nozzle;

applying the resultant combustion gas to melt or vaporize a metal material fed by the metal material feeder; and contacting the produced molten metal droplets or vapor with high-pressure water to crush and solidify the droplets/vapor to produce fine metallic particles which precipitate in water for recovery.

2. The method for producing metallic particles as described in claim 1, wherein the inert gas in the upper space of the high-pressure water tank is fed into the high-pressure water via a pump and said gas is collected as it travels upward in the high-pressure water, dried, and then released into the upper space.

3. The method as described in claim 2, wherein said metal material is titanium, zirconium, germanium, tin, gold, platinum or silver.

4. The method as described in claim 2, wherein the shape of said metal material is bar, sheet, wire, foil or granule, or any combination thereof.

5. The method for producing metallic particles as described in claim 1, wherein said metal material is titanium, zirconium, germanium, tin, gold, platinum or silver.

6. The method as described in claim 5, wherein the shape of said metal material is bar, sheet, wire, foil or granule, or any combination thereof.

7. The method for producing metallic particles as described in claim 1, wherein the shape of said metal material is bar, sheet, wire, foil or granule, or any combination thereof.

8. The method as described in claim 1, further electrolyzing water to produce the mixture gas of oxygen and hydrogen before introducing the mixture gas into the combustion chamber.

* * * * *